US011462848B2

(12) United States Patent
Listing et al.

(10) Patent No.: US 11,462,848 B2
(45) Date of Patent: Oct. 4, 2022

(54) CONICAL CONTACT SPRING SLEEVE AS WELL AS ELECTRICAL CONNECTORS AND PLUG CONNECTIONS WITH SUCH CONTACT SPRING SLEEVES

(71) Applicant: TE Connectivity Germany GmbH, Bensheim (DE)

(72) Inventors: Martin Listing, Bensheim (DE); Bernd Leonhardt, Bensheim (DE); Maximilian Veihl, Bensheim (DE); Christoph Kosmalski, Bensheim (DE); Harald Ulrich, Bensheim (DE); Stefan Masak, Bensheim (DE); Rajesh Kumar, Bensheim (DE); Kevin Scheer, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/188,498

(22) Filed: Mar. 1, 2021

(65) Prior Publication Data

US 2021/0273364 A1 Sep. 2, 2021

(30) Foreign Application Priority Data

Feb. 28, 2020 (DE) ..... 10 2020 202609.2

(51) Int. Cl.

| | |
|---|---|
| ***H01R 13/187*** | (2006.01) |
| ***H01R 13/11*** | (2006.01) |
| ***H01R 13/20*** | (2006.01) |
| *H01R 13/04* | (2006.01) |

(52) U.S. Cl.
CPC ..... *H01R 13/111* (2013.01); *H01R 13/20* (2013.01); *H01R 13/04* (2013.01)

(58) Field of Classification Search
CPC ..... H01R 13/111; H01R 13/20
See application file for complete search history.

(56) References Cited

U.S. PATENT DOCUMENTS

| | | | | |
|---|---|---|---|---|
| 4,083,622 | A * | 4/1978 | Neidecker | H01R 13/187 439/86 |
| 4,128,293 | A * | 12/1978 | Paoli | H01R 13/187 439/927 |
| 4,405,196 | A * | 9/1983 | Fulton | H01R 13/20 439/724 |
| 4,550,972 | A * | 11/1985 | Romak | H01R 13/111 439/843 |
| 5,474,479 | A * | 12/1995 | Bennett | H01R 13/187 439/843 |

(Continued)

FOREIGN PATENT DOCUMENTS

| | | |
|---|---|---|
| CN | 201946783 U | 8/2011 |
| CN | 109994859 A | 7/2019 |

OTHER PUBLICATIONS

Extended European search report in Appln. No. 21159462.7-1201, dated Jul. 6, 2021, 8 pp.

*Primary Examiner* — Neil Abrams
(74) *Attorney, Agent, or Firm* — Barley Snyder

(57) ABSTRACT

A conical contact spring sleeve includes a radial concavity that projects radially inwards beyond an inner peripheral surface of the conical contact spring sleeve and/or a radial convexity that projects radially outwards beyond an outer peripheral surface of the conical contact spring sleeve.

12 Claims, 6 Drawing Sheets

(56) References Cited

U.S. PATENT DOCUMENTS

| | | | | |
|---|---|---|---|---|
| 5,601,457 | A * | 2/1997 | Le Gall | H01R 13/187 439/843 |
| 5,667,413 | A * | 9/1997 | Trafton | H01R 13/187 439/271 |
| 5,915,758 | A * | 6/1999 | Alfiero | H01M 50/543 29/854 |
| 6,062,919 | A * | 5/2000 | Trafton | H01R 13/187 439/843 |
| 7,462,078 | B2 * | 12/2008 | Mao | H01R 13/187 439/843 |
| 8,057,269 | B2 * | 11/2011 | Ledermann | H01R 13/187 439/843 |
| 8,702,438 | B2 * | 4/2014 | Frank | H01R 13/111 439/843 |
| 8,731,671 | B2 * | 5/2014 | Rodby | H01R 13/187 607/36 |
| 9,608,341 | B2 * | 3/2017 | Saur | H01R 13/187 |
| 10,135,167 | B2 * | 11/2018 | Wollitzer | H01R 13/187 |
| 10,270,196 | B2 * | 4/2019 | Wang | H01R 24/20 |
| 10,535,943 | B2 * | 1/2020 | Szymura | H01R 13/187 |
| 10,879,656 | B2 * | 12/2020 | Wang | H01R 13/66 |
| 10,923,846 | B1 * | 2/2021 | Raybold | H01R 13/187 |
| 11,139,600 | B1 * | 10/2021 | Kinsey, Jr. | H01R 13/111 |
| 2003/0068931 | A1 | 4/2003 | Swearingen et al. | |
| 2021/0273364 | A1 * | 9/2021 | Listing | H01R 13/111 |

* cited by examiner

CONICAL CONTACT SPRING SLEEVE AS WELL AS ELECTRICAL CONNECTORS AND PLUG CONNECTIONS WITH SUCH CONTACT SPRING SLEEVES

CROSS-REFERENCE TO RELATED APPLICATION

This application claims the benefit of the filing date under 35 U.S.C. § 119(a)-(d) of German Patent Application No. 102020202609.2, filed on Feb. 28, 2020.

FIELD OF THE INVENTION

The present invention relates to an electrical contact and, more particularly, to a contact spring sleeve for an electrical contact.

BACKGROUND

Detachable plug connections are used in automotive engineering for the transmission of electric currents and signals in a variety of applications. For example, cylindrical pin contacts and cylindrical sleeve contacts with cylindrical contact springs are used in the plug connections to create the electric contacting. When sliding the pin and sleeve contacts into each other, friction occurs between the individual contact surfaces from the beginning of the insertion process until an end position is reached. The friction can cause damage to the respective contact surfaces and thus limits the maximum permissible contact force that can be exerted by the contact springs. The applicability of coatings on the respective contact surfaces is also limited due to the expected high surface wear.

Both the contact force and the condition of the contact surfaces have an influence on the contact resistance, which in turn has a significant effect on the current-carrying capacity of the plug connection.

SUMMARY

A conical contact spring sleeve includes a radial concavity that projects radially inwards beyond an inner peripheral surface of the conical contact spring sleeve and/or a radial convexity that projects radially outwards beyond an outer peripheral surface of the conical contact spring sleeve.

BRIEF DESCRIPTION OF THE DRAWINGS

The invention will now be described by way of example with reference to the accompanying Figures, of which.

DETAILED DESCRIPTION OF THE EMBODIMENT(S)

Features and exemplary embodiments as well as advantages of the present disclosure will be explained in detail with respect to the drawings. It is understood that the present disclosure should not be construed as being limited by the description of the following embodiments. It should furthermore be understood that some or all of the features described in the following may also be combined in alternative ways.

First, the schematic structure of possible embodiments of a contact spring sleeve 1 and an electrical connector 2 according to the invention is shown with reference to FIGS. 1 to 4. Then the schematic structure of possible embodiments of an electrical plug connection 4 is described with reference to FIGS. 5 and 6.

Figure 1:
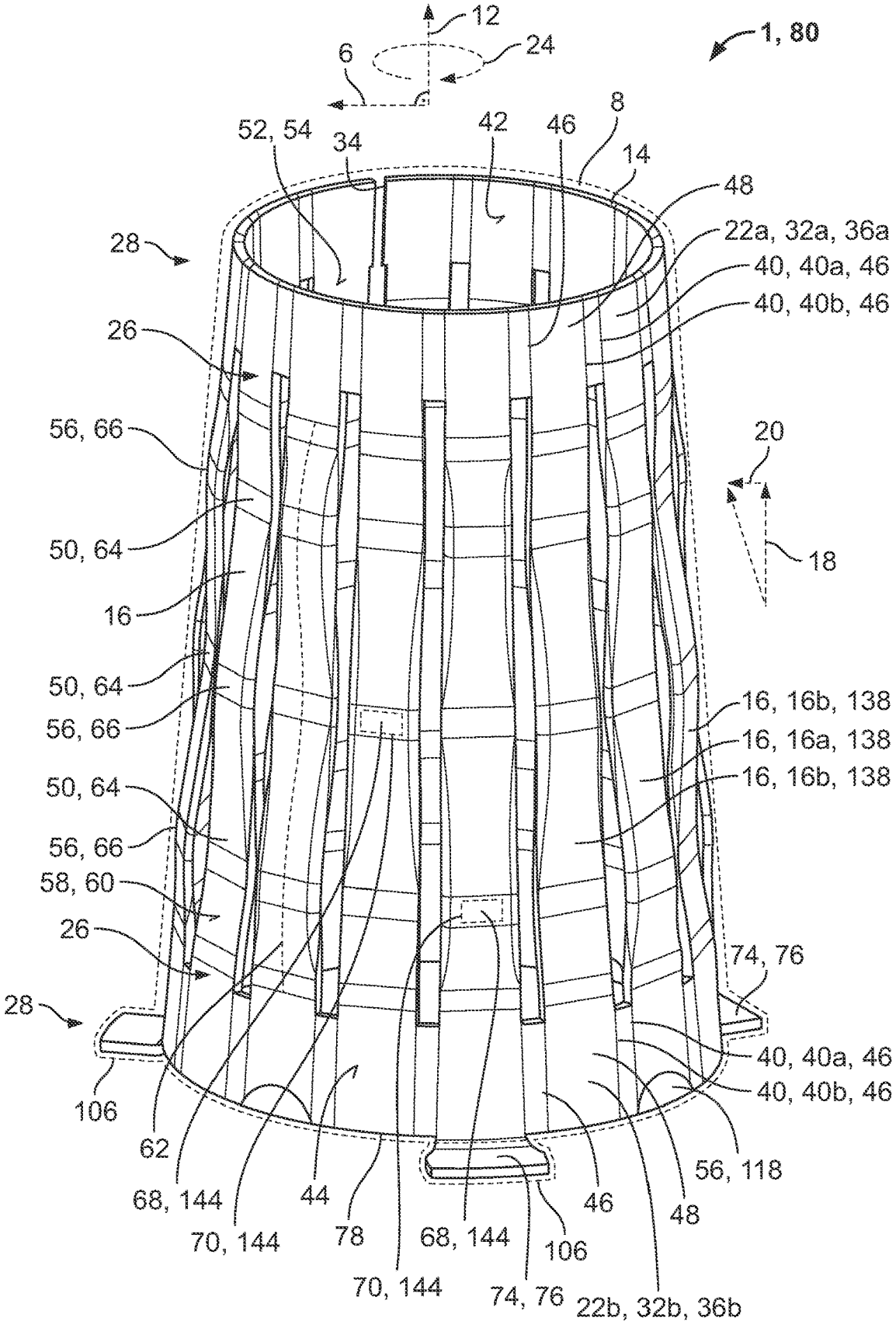
FIG. 1 is a perspective view of a contact spring sleeve according to an embodiment.

As shown in FIG. 1, the contact spring sleeve 1 can have a conical shape 8, which extends in an axial direction 12. The terms "conical" and "conical shape" are used herein to describe shapes that include not only cones and truncated cones but also wedges and truncated wedges. The conical contact spring sleeve 1 can be formed as a hollow truncated cone 14. In particular, the conical contact spring sleeve 1 can have a plurality of webs 16, which are lamellar or leaf-spring shaped and arranged in a closed form. The webs 16 extend obliquely in the axial direction 12 with respect to the conical shape 8. More precisely, the direction in which the webs 16 extend has a component 18 pointing in the axial direction 12. In addition, the direction in which the webs 16 extend can also have a radial component 20 and/or a circumferential component. In an embodiment, the contact spring sleeve 1 is a stamped bent part.

The webs 16, as shown in FIG. 1, can extend between two rings 22*a*, 22*b* with respect to the conical shape 8 and be connected to the two rings 22*a*, 22*b* with a material bond, whereby the rings 22*a*, 22*b* extend in the circumferential direction 24 with respect to the conical shape 8. In particular, two opposite ends 26 of each web 16 with respect to the axial direction 12 are each connected to a ring 22*a*, 22*b*, in an embodiment monolithically, so that the rings 22*a*, 22*b* are each arranged at one axial end 28 of the conical contact spring sleeve 1. The rings 22*a*, 22*b* can be closed or partially open rings, especially polygonal rings 32*a*, 32*b* or circular rings 30*a*, 30*b*. Circular rings 30*a*, 30*b* are not susceptible to stress peaks due to their round shape while polygonal rings 32*a*, 32*b* can prevent twisting of the contact spring sleeve 1 at or in the conical contact, since they can absorb forces which act in the circumferential direction with respect to the conical shape when inserted in a correspondingly complementary shaped recess.

FIG. 1 shows the conical contact spring sleeve 1 with polygonal rings 32*a*, 32*b*, which are open at at least one point 34. In another embodiment, closed rings can be produced, for example, by a deep-drawing process or by a material-bonding closure of the at least one point 34. The polygonal rings 32*a*, 32*b* serve as connecting pieces 36*a*, 36*b*, with which the respective ends 26 of the webs 16 are monolithically connected. The connecting pieces 36*a*, 36*b* each have at least one bend 40, for example two bends 40*a*, 40*b*, between two circumferentially 24 adjacent webs 16*a*, 16*b*, so that the conical contact spring sleeve 1 has a plurality of facets 48 on inside surfaces 42 and outside surfaces 44 of the polygonal rings 32*a*, 32*b*, which are delimited by bending edges 46.

As shown in FIG. 1, the conical contact spring sleeve 1 has at least one radial concavity 50, which projects radially inwards with respect to the conical shape 8 beyond an inner peripheral surface 52 of the conical contact spring sleeve 1, an inner cone surface 54 in an embodiment, and/or at least one radial convexity 56, which projects radially outwards beyond an outer peripheral surface 58 of the conical contact spring sleeve 1, an outer cone surface 60 in an embodiment.

In the embodiment shown, the conical contact spring sleeve 1 has a plurality of such radial concavities 50 and radial convexities 56. The inner peripheral surface 52 may also be synonymously termed inner circumferential surface or inner shell surface. The outer peripheral surface 58 may also be synonymously termed outer circumferential surface or outer shell surface.

The radial concavities 50 and radial convexities 56 can be located on the webs 16 of the conical contact spring sleeve 1. The webs 16 can have a curved shape 62 so that at least one section 64 of the respective web 16 is inwardly vaulted and at least one section 66 of the respective web 16 is outwardly bulged. In particular, vaulted sections 64 and bulged sections 66 can be arranged alternately along the axial direction 12 and/or along the circumferential direction 24 so that evenly distributed contact points 68 and contact surfaces 70 are produced in and on the conical contact spring sleeve 1. This is shown in FIGS. 1 to 3.

In an embodiment, the at least one radial concavity 50 and/or convexity 56 is spaced apart from the rings 22*a*, 22*b*. Alternatively or additionally, the at least one radial concavity 50 and/or convexity 56 can be located on one or both rings 22*a*, 22*b* to create additional contact points.

Figure 2:
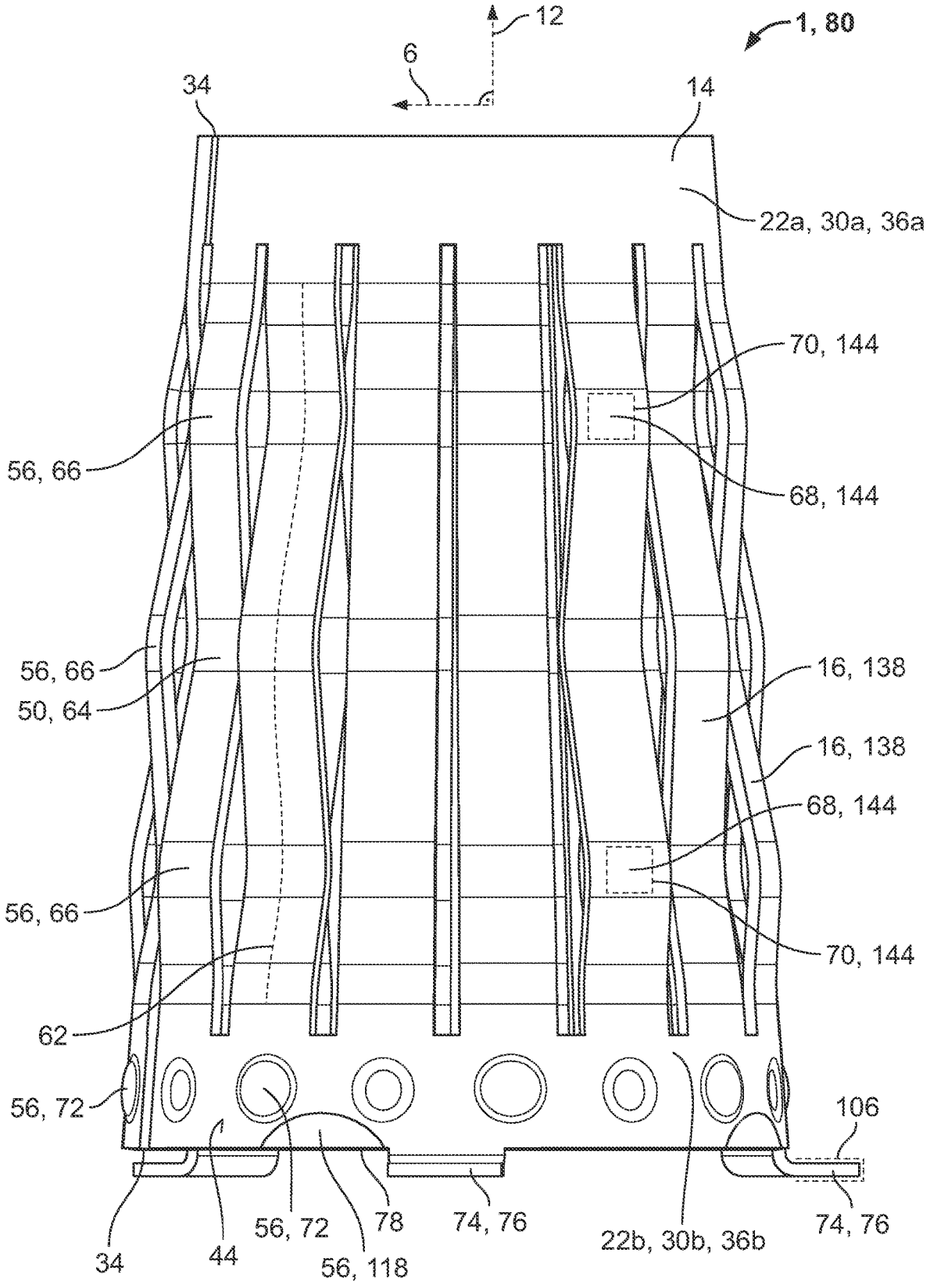
FIG. 2 is a side view of a contact spring sleeve according to another embodiment.
Figure 3:
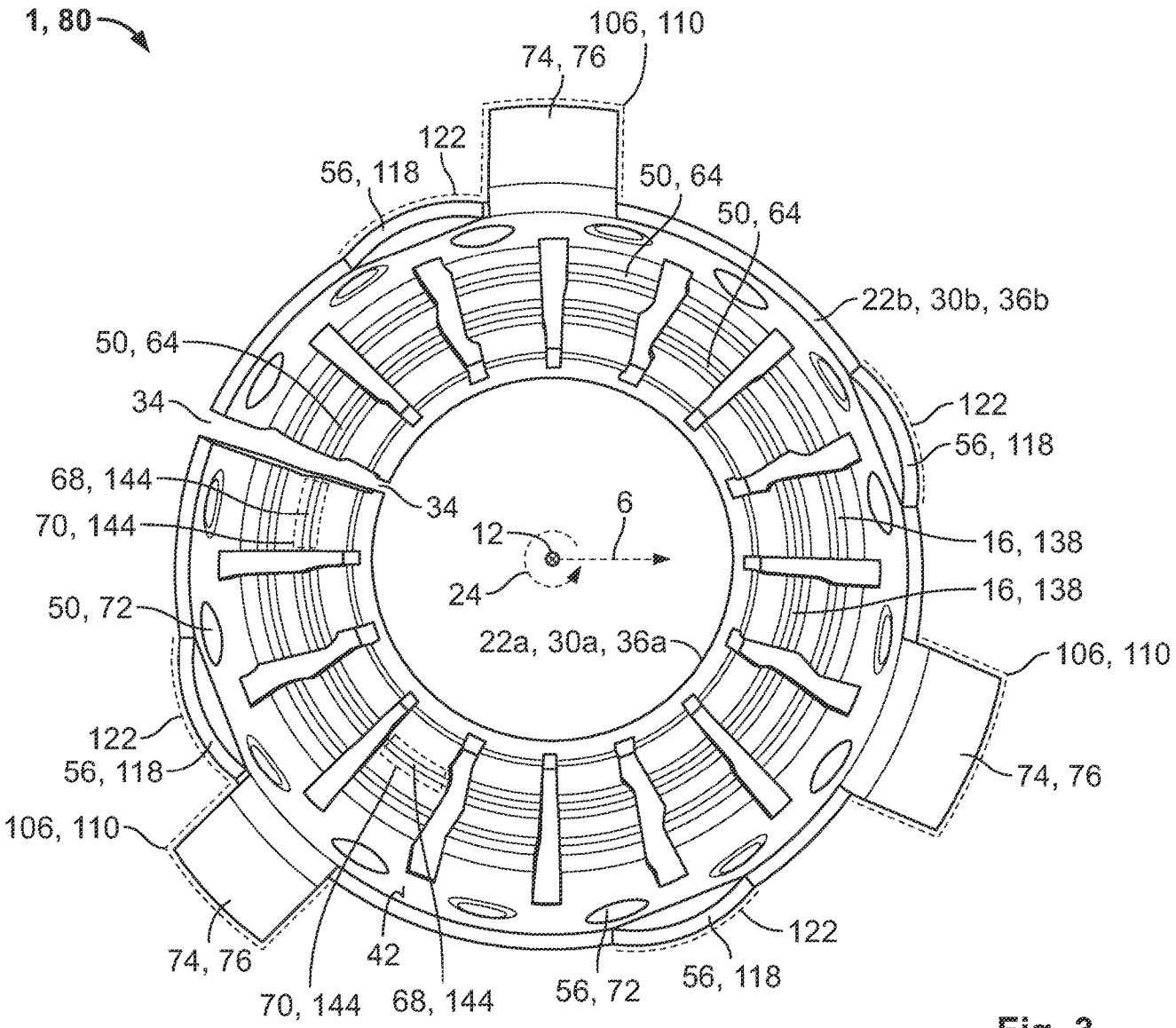
FIG. 3 is a bottom view of the contact spring sleeve of FIG. 2.

FIGS. 2 and 3 show the conical contact spring sleeve 1 alternatively with circular rings 30*a*, 30*b*, which are also open at at least one point 34. Alternatively, they can also be closed rings instead. It is also visible that the radial concavities 50 and/or the radial convexities 56 can additionally be formed as dome-shaped knobs 72, which for example on at least one of the two rings 22*a*, 22*b* project radially inwards on the inner surface 42 or radially outwards on the outer surface 44.

The conical contact spring sleeve 1 can also have at least one twist protection 74, as shown in FIGS. 2 and 3. In the embodiment shown, the twist protection 74 is realized by at least one lamellar tongue 76, for example three lamellar tongues 76. The lamellar tongues 76 can protrude from at least one of the two rings 22*a*, 22*b* perpendicular to the axial direction 12. In particular, the lamellar tongues 76 can be monolithically connected with an outer edge 78 of one of the two rings 22*a*, 22*b* and bent outwards in radial direction 6. Alternatively, the at least one lamellar tongue 76 can be bent inwards.

The conical contact spring sleeve 1 shown can be, for example, a punched and bent part 80, which is produced by punching out a flat metal workpiece, such as a contact sheet, and then bending it into the shape shown. Of course, the conical contact spring sleeve 1 can also be produced by other, for example automated, manufacturing methods.

Figure 4:
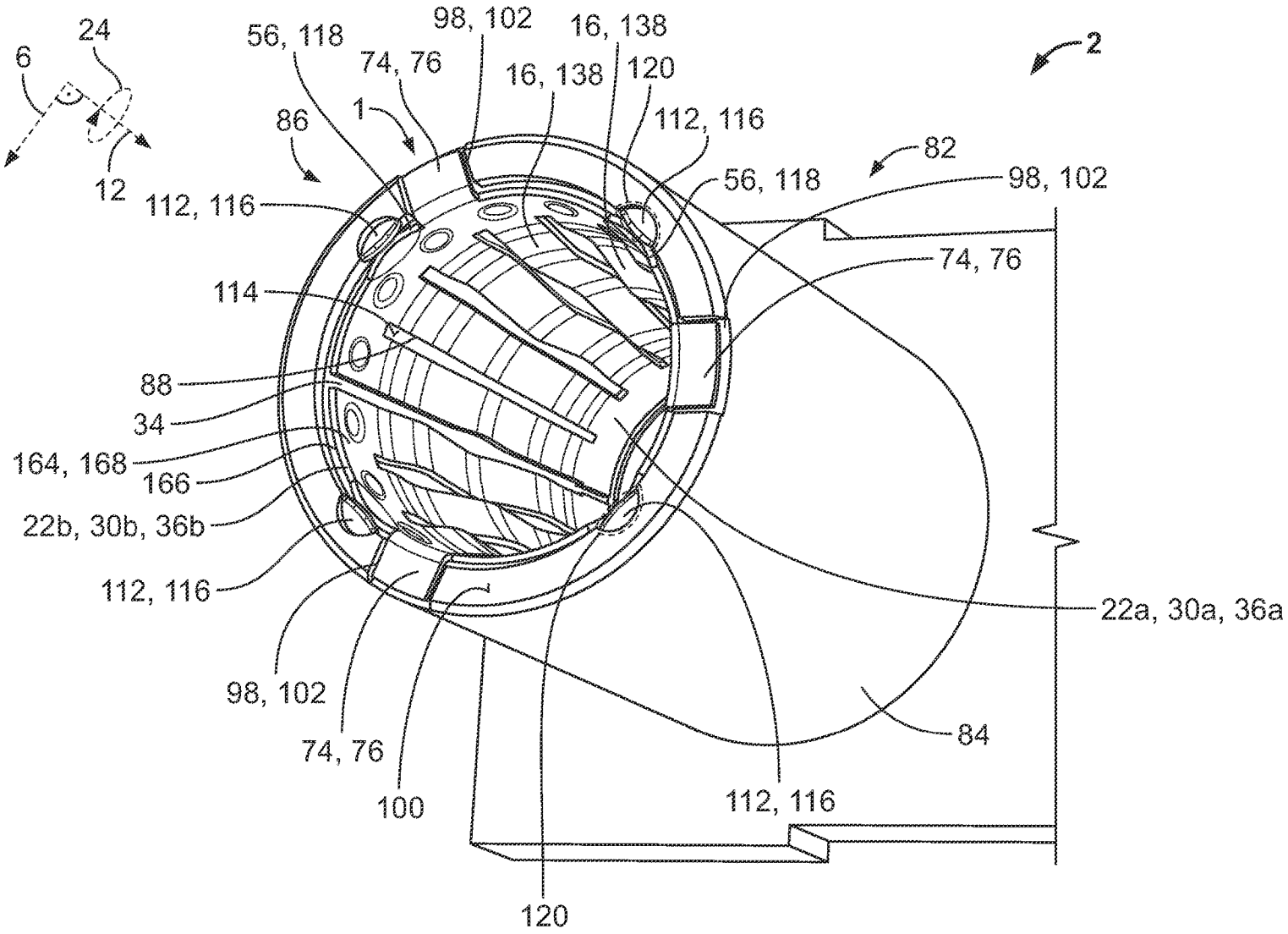
FIG. 4 is a perspective view of an electrical connector according to an embodiment.

FIG. 4 shows an exemplary embodiment of the electrical connector 2 according to the invention. The electrical connector 2 can comprise the conical contact spring sleeve 1 and a socket-shaped conical contact 82. In particular, the socket-shaped conical contact 82 has a cylindrical sleeve shape 84 in which a receptacle 86 with an inner cone 88 is formed. The conical contact spring sleeve 1 can be inserted into the receptacle 86 and can be arranged in surface contact with the inner cone 88. The conical contact spring sleeve 1, in an embodiment, is captive in the socket-shaped conical contact 82. More precisely, the conical contact spring sleeve 1 is fixed in the axial direction 12, radial direction 6 and circumferential direction 24 in the socket-shaped conical contact 82.

Figure 5:
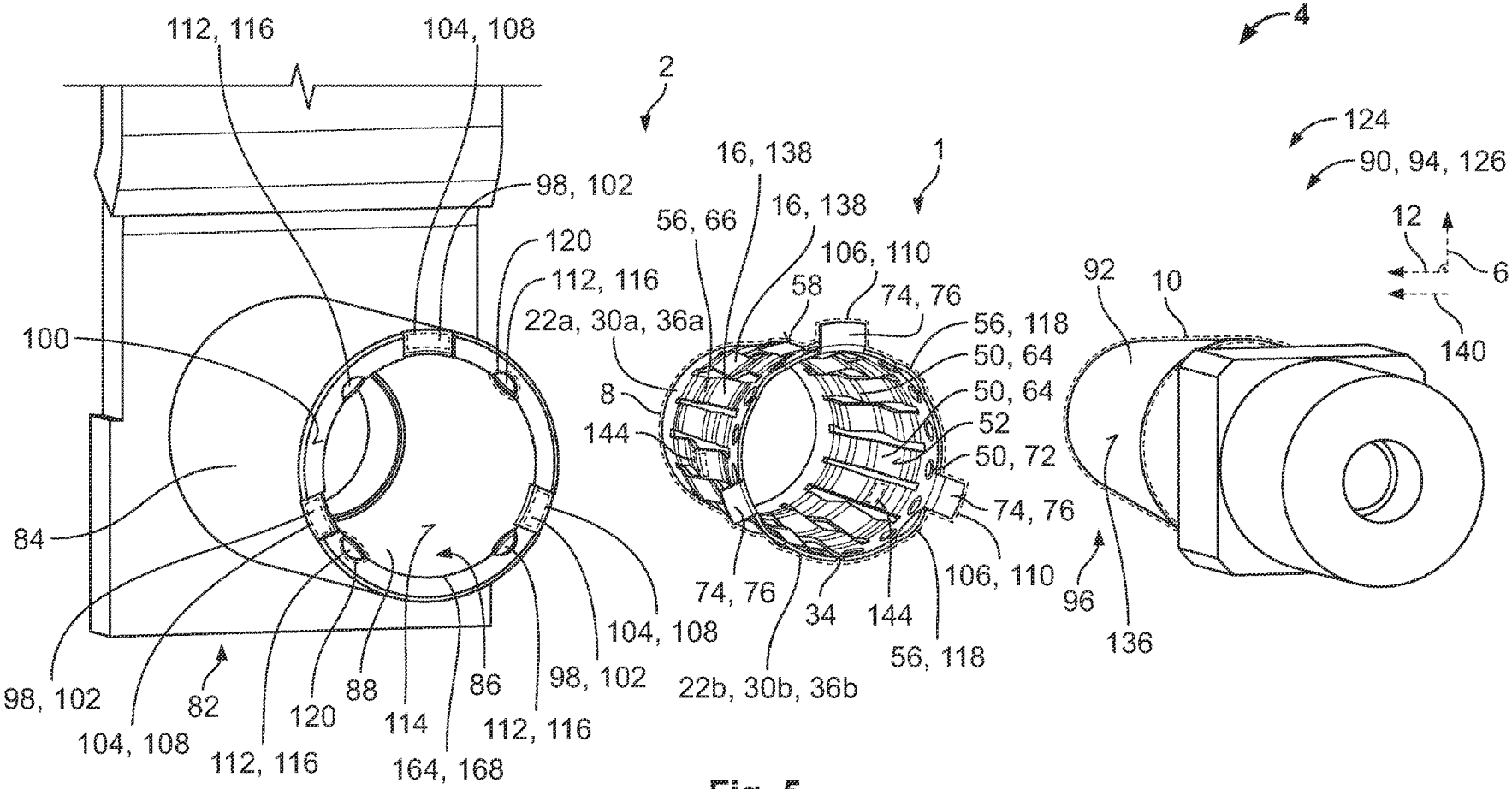
FIG. 5 is an exploded perspective view of an electrical plug connection according to an embodiment.

Alternatively, the electrical connector 2 can also include a plug-shaped conical contact 90, as shown in FIG. 5. In this case the conical contact spring sleeve 1 is placed on an outer cone 92 of the plug-shaped conical contact 90. In particular, the plug-shaped conical contact 90 is formed as a pin contact 94 which has the outer cone 92 at one axial end 96. In this case, the conical contact spring sleeve 1 is surface-mounted on the outer cone 92 and captively fixed.

As shown in FIG. 4, the conical contact spring sleeve 1 is detachably attached to the socket-shaped conical contact 82. For this purpose, the lamellar tongues 76 of the conical contact spring sleeve 1 can each be engagingly recessed in a recess 98 of the socket-shaped conical contact 82 extending perpendicular to the axial direction 12, in order to be able to absorb forces acting on the conical contact spring sleeve 1 in the circumferential direction 24. For this purpose, the recesses 98 can be formed as grooves 102 extending in the radial direction 6 on an end face 100 of the socket-shaped conical contact 82, whereby an inner contour 104 of the grooves 102 corresponds to an outer contour 106 of the lamellar tongues 76, as shown in FIG. 5. The grooves 102 are distributed in the circumferential direction 24 over the end face 100 so that their position 108 corresponds to the position 110 of the associated lamellar tongue 76 in each case.

In addition or alternatively, the socket-shaped conical contact 82 can have at least one embossing 112 on the end face 100, as shown in FIG. 4, which projects radially inwards into the receptacle 86 on the inner cone 88 beyond an inner peripheral surface 114 of the socket-shaped conical contact 82. FIG. 4 shows an example of the socket-shaped conical contact 82 with four such embossings 112, each of which has a lenticular projection 116. It can be seen that the lenticular projections 116 protrude into receptacle 86 and support the conical contact spring sleeve 1 in axial direction 12. Thus, forces acting on the conical contact spring sleeve 1 against the axial direction 12 can be absorbed for fixing the conical contact spring sleeve 1. For this purpose, radial convexities 56 formed as spout-like convexities 118 are for instance provided at the conical contact spring sleeve 1, said convexities being arranged at one of the two rings 22*a*, 22*b*, in particular at an axial end 28 of the conical contact spring sleeve 1 at positions 122 corresponding to the positions 120 of the embossings 112, as shown in FIG. 3.

The contact spring sleeve 1 can be adapted to be expandable or compressible in the radial and/or circumferential direction. In an embodiment, both rings 22*a*, 22*b* of the contact spring sleeve 1 are open at at least one point and each has a flexible, constant cross-section. The contact spring sleeve 1 can thus be snapped onto the conical contact 82, 90 or spread into the conical contact 82, 90.

The conical contact spring sleeve 1 can also be detachably attached to the plug-shaped conical contact 90, shown in FIG. 5. For this purpose, the outer cone 92 of the plug-shaped conical contact 90 can have at least one outwardly projecting embossing which supports at least one radial concavity of the conical contact spring sleeve 1 in the axial direction 12. In addition, the at least one lamellar tongue 76 of the conical contact spring sleeve 1 can be directed inwards and protrude into a slot of the plug-shaped conical contact 90 extending perpendicularly to the axial direction 12.

Figure 6:
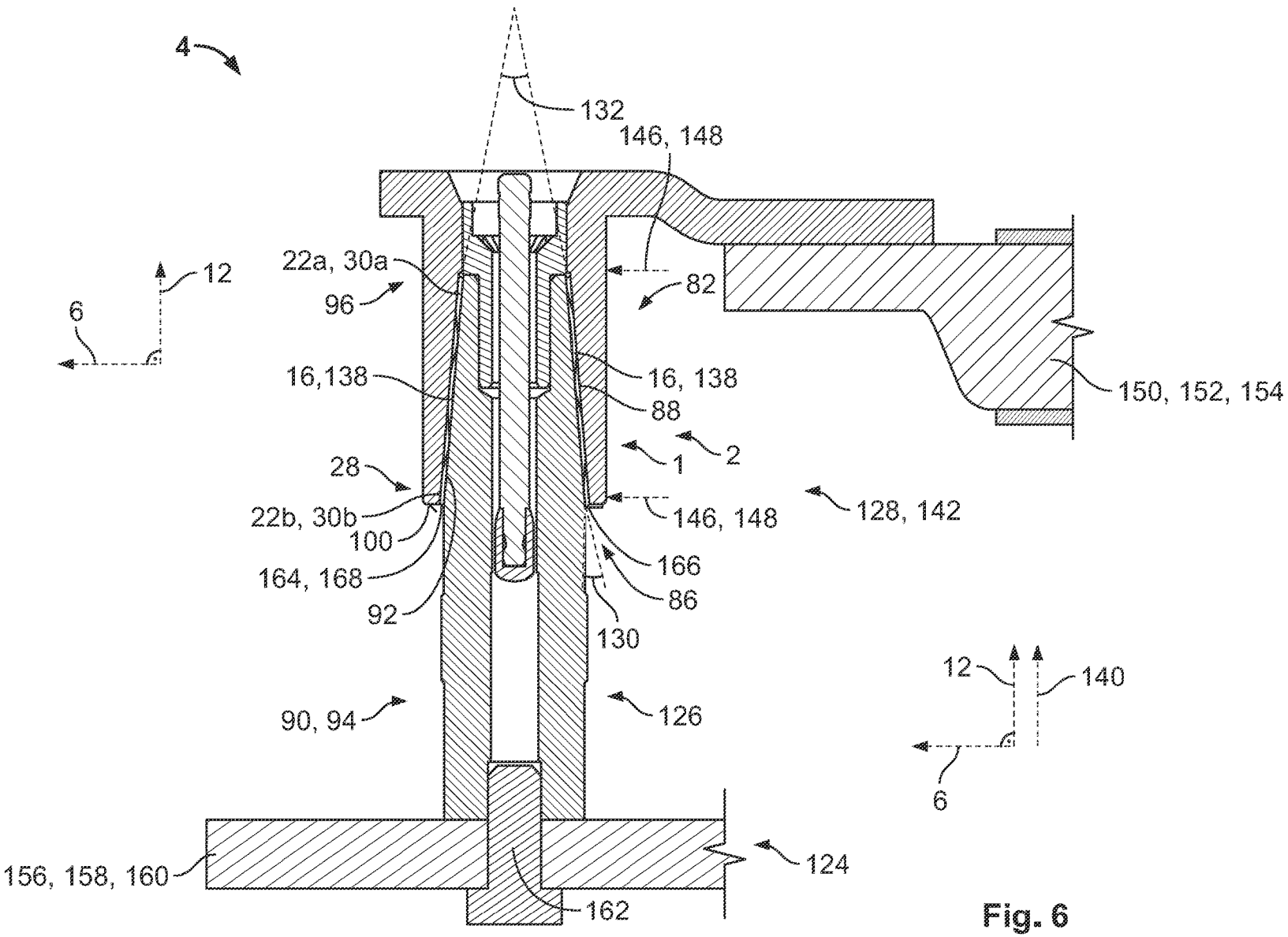
FIG. 6 is a sectional side view of an electrical plug connection according to another embodiment.

FIGS. 5 and 6 each show a possible embodiment of the electrical plug connection 4 according to the invention, which comprises an electrical connector 2 according to the above embodiments and a mating connector 124 with a mating contact 126 which is conical at the same angle to the conical contact 82, 90 of connector 2. The mating contact 126 here has a conical shape 10 complementary to the conical shape 8 of the conical contact 82, 90. Optionally, the conical contact 82, 90, the conical contact spring sleeve 1 and/or the mating contact 126 can be lubricated at least in sections. In particular, the contact surfaces of the conical contact 82, 90, the conical contact spring sleeve 1 and/or the mating contact 126 can be oiled, greased or lubricated with a contact oil, contact grease or other contact lubricant. This increases the resistance of the corresponding contact surfaces to dirt, oxidation and corrosion.

The connector 2 may include a connector housing in or on which the conical contact 82 and/or the contact spring sleeve 1 is fixed. The connector housing can optionally have a straight guide for moving forward the mating connector 124 with the mating contact 126. In particular, the straight guide can be adapted in such a way that the conical contact 82 and the mating contact 126 are slid into each other in a continuously aligned manner during a plug process between the connector 2 and the mating connector 124. This prevents the respective contact surfaces from rubbing unnecessarily against each other during the plug process when the conical contact 82 and the mating contact 126 are slid into each other. This improves the wear behavior of the connector 2 and mating connector 124.

Alternatively or additionally, the connector housing can have a fastening device for fastening the mating connector 124. In an embodiment, this is a fastening device for creating a detachable connection, such as a snap-in connection and/or screw connection. Optionally, the connector housing can have an additional locking device, for example a connector position lock. In addition, in an optional embodiment, at least one finger protection element can be attached to the conical contact 82 and/or the connector housing to protect the contact surfaces from unintentional contact with foreign objects, such as human fingers, thus increasing the electrical safety of the electrical connector 2.

In the embodiment shown in FIG. 6, the conical contact 82, 90 and the mating contact 126 can form a self-locking connection 128. In the exemplary embodiment shown, this is achieved by forming the conical shapes 8, 10 in such a way that the half angle 130 of the cone angle 132 is smaller than the friction angle, whereby the friction angle results from the arc tangent of the static friction coefficient between the conical contact 82, 90 and the mating contact 126. For example, the friction angle results from the arc tangent of the static friction coefficient between the inner peripheral surface 114 of the socket-shaped conical contact 82 and the outer peripheral surface 136 of the plug-shaped mating contact 126.

FIG. 5 shows the conical contact spring sleeve 1 with a plurality of spring sections 138, which are flexible in the axial direction 12 and the radial direction 6. The flexible spring sections 138 are each formed by a web 16 of the conical contact spring sleeve 1. When the conical contact 82, 90 and the mating contact 126 are slid into each other along a plug-in direction 140, which is parallel to the axial direction 12 in an embodiment, the flexible spring sections 138 are deformed. More precisely, the flexible spring sections 138 are compressed and stretched between the inner peripheral surface 114 of the socket-shaped conical contact 82 and the outer peripheral surface 136 of the plug-shaped mating contact 126. This can be seen in FIG. 6, for example. The rings 22*a*, 22*b* can protect the webs 16 from bending, for example during the sliding of the conical contact 82, 90 and the mating contact 126 into each other.

By stretching the flexible spring sections 138, a preload is built up which ensures reliable electric contacting between the conical contact 82, 90 and the mating contact 126. The electric contacting can particularly take place in the plugged state 142 of the electrical connector 2 and the mating connector 124 at point-shaped or surface-shaped contact areas 144. The contact areas 144 can optionally be provided with a coating, for example with a silver coating or a coating containing a precious metal component. The coating can be applied by a galvanic, thermal, chemical or physical method. For example, CVD processes, PVD processes or other technical coating methods can be used. The coating improves the surface property of the coated contact surface, so that the contact resistance decreases and consequently the current carrying-capacity increases. The contact area 144 of the at least one radial concavity 50 and/or convexity 56 can also be used to absorb external forces.

In the plugged state 142 shown in FIG. 6, the conical contact 82, 90 and the mating contact 126 are each at an end position 146. The end position 146 is characterized by the fact that the conical contact 82, 90 and mating contact 126 are at an abutment 148 or the self-locking connection 128 is present.

As also shown in FIG. 6, the socket-shaped conical contact 82 can be welded to at least one conductor 150 of an electrical cable 152, for example a shielded cable 154. The plug-shaped mating contact 126 may in turn be screwed to at least one conductor 156 of an electrical rail 158, for example a busbar 160, by means of a screw connection 162. Alternative connection types, such as soldered connections and/or crimp connections can also be used. The arrangement of the cable-side and rail-side conical contact can also be reversed.

FIG. 6 shows that an axial end 28 of the conical contact spring sleeve 1 can be arranged flush with an insertion opening 164 of the receptacle 86. In particular, an outer edge 166 of one of the two rings 22*a*, 22*b* of the conical contact spring sleeve 1 is flush with an inner edge 168 of the insertion opening 164. Alternatively, there can be an offset between the outer edge 166 and the inner edge 168. This is visible in FIG. 4. For example, the lamellar tongues 76 of the twist protection 74 may have a bending radius that extends beyond the outer edge 166 against the axial direction 12 and results in the conical contact spring sleeve 1 being positioned deeper in the receptacle 86 than the inner edge 168.

Wear that may occur when the conical contact 82, 90 and the mating contact 126 are slid into each other up to the end position 146 is reduced, since due to the complementary conical shapes, the conical contact 82, 90 and the mating contact 126 can be slid into each other sectionally without direct contact. Direct contact between the conical contact 82, 90 and the mating contact 126 only occurs in the immediate vicinity of the end position 146. The end position 146 can be characterized by the fact that the conical contact 82, 90 and the mating contact 126 are each at an abutment. At the abutment, for example, the end face 100 can rest on a shoulder and/or on a recess of the mating contact 126. Alternatively or additionally, a maximum compression of the contact spring sleeve 1 in radial direction 6 of the conical shape 8 can be achieved at the abutment. However, the end position 146 can also be at a distance from the abutment. In particular, the conical contact 82, 90 can work without a discrete abutment and can be used accordingly.

When the conical shapes complementary to each other are slid into each other, a self-centering effect can be achieved, effecting an axial alignment of the conical contact 82, 90 and the mating contact 126 with respect to the conical shapes thereby effecting a uniform electric contacting. Furthermore, the conical shapes can be adapted in such a way that a self-locking connection is created between the conical contact 82, 90 and the mating contact 126. The end position 146 can then be characterized by the presence of the self-locking connection. Among other things, the vibration resistance of the plug connection 4 is increased, since the preloaded contact spring sleeve 1 can compensate to a certain degree for relative movements between the conical contact 82, 90 and the mating contact 126 under dynamically changing external stresses, such as vibrations and/or shocks.

What is claimed is:

1. A conical contact spring sleeve, comprising:

a plurality of webs each having a radial concavity that projects radially inwards beyond an inner peripheral surface of the conical contact spring sleeve and a radial convexity that projects radially outwards beyond an outer peripheral surface of the conical contact spring sleeve, the radial concavities and the radial convexities are arranged alternately along a circumferential direction.

2. The conical contact spring sleeve of claim 1, wherein the plurality of webs extend in an axial direction.

3. The conical contact spring sleeve of claim 2, further comprising a pair of rings, the plurality of webs extend in the axial direction between the pair of rings.

4. The conical contact spring sleeve of claim 3, wherein the radial concavity and/or the radial convexity is spaced apart from the pair of rings.

5. The conical contact spring sleeve of claim 4, wherein the pair of rings are each located at an axial end of the contact spring sleeve.

6. The conical contact spring sleeve of claim 1, wherein the plurality of webs are lamellar or leaf spring shaped.

7. An electrical connector, comprising:

a conical contact having a plug-shape or a socket-shape; and a contact spring sleeve including a plurality of webs each having a radial concavity that projects radially inwards beyond an inner peripheral surface of the contact spring sleeve and a radial convexity that projects radially outwards beyond an outer peripheral surface of the contact spring sleeve, the radial concavities and the radial convexities are arranged alternately along a circumferential direction.

8. The electrical connector of claim 7, wherein the contact spring sleeve is captively attached to or in the conical contact.

9. An electrical plug connection, comprising:

a connector including:

a conical contact having a plug-shape or a socket-shape; and a contact spring sleeve including a plurality of webs each having a radial concavity that projects radially inwards beyond an inner peripheral surface of the conical contact spring sleeve and a radial convexity that projects radially outwards beyond an outer peripheral surface of the contact spring sleeve, the radial concavities and the radial convexities are arranged alternately along a circumferential direction; and a mating connector having a mating contact with a conical shape, the conical contact and the mating contact are electrically connected by the contact spring sleeve.

10. The electrical plug connection of claim 9, wherein the conical contact and the mating contact are connected in a self-locking manner.

11. The electrical plug connection of claim 9, wherein the conical contact is lubricated, the contact spring sleeve is lubricated, and/or the mating contact is lubricated.

12. The electrical plug connection of claim 9, wherein the contact spring sleeve has a spring section that is flexible in a radial direction and/or in an axial direction.

* * * * *